US008331825B2

(12) United States Patent
Itabashi

(10) Patent No.: US 8,331,825 B2
(45) Date of Patent: Dec. 11, 2012

(54) IMAGE FORMING APPARATUS HAVING SUPPORT MEMBER FOR SUPPORTING EXPOSURE MEMBER

(75) Inventor: Nao Itabashi, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 23 days.

(21) Appl. No.: 12/323,827

(22) Filed: Nov. 26, 2008

(65) Prior Publication Data

US 2009/0180798 A1 Jul. 16, 2009

(30) Foreign Application Priority Data

Nov. 29, 2007 (JP) ..... 2007-309080

(51) Int. Cl.
*G03G 15/00* (2006.01)

(52) U.S. Cl. ..... 399/107; 399/110; 399/124; 399/125; 399/126

(58) Field of Classification Search ..... 399/107, 399/110, 124–126
See application file for complete search history.

(56) References Cited

U.S. PATENT DOCUMENTS

| | | | | |
|---|---|---|---|---|
| 5,620,122 | A | 4/1997 | Tanaka | |
| 5,808,649 | A | 9/1998 | Shimanari et al. | |
| 6,038,417 | A * | 3/2000 | Nagamine et al. | 399/125 |
| 2001/0052524 | A1 | 12/2001 | Ichimaru et al. | |

FOREIGN PATENT DOCUMENTS

| | | |
|---|---|---|
| JP | 05-309894 | 11/1993 |
| JP | 08-156698 | 6/1996 |
| JP | 09-160333 | 6/1997 |
| JP | 2001-336335 | 12/2001 |
| JP | 2003-112446 | 4/2003 |
| JP | 2007-065125 | 3/2007 |

OTHER PUBLICATIONS

English Translation of JP 5309894 to Morimoto et al.*
Morimoto et al. JP 5309894 Nov. 22, 1993.*

* cited by examiner

*Primary Examiner* — Ryan Walsh
(74) *Attorney, Agent, or Firm* — Banner & Witcoff, Ltd.

(57) ABSTRACT

An image forming apparatus includes: process units arranged along a first direction and a second direction opposite to the first direction, each process unit including a photoconductor; exposure members arranged such that the exposure members and the process units are alternately arranged along the first and second directions; a support member that supports the exposure members and that is configured to rotate around an axis located in the first direction relative to the exposure members, such that the exposure members are advanced and retracted, in association with a rotation movement of the support member, between an advanced position where the exposure members are respectively advanced into spaces defined between the adjacent process units and a retracted position where all of the plurality of exposure members retracted from the respective spaces. The axis is movable along a direction orthogonal to an axial direction in association with the rotation movement.

19 Claims, 14 Drawing Sheets

IMAGE FORMING APPARATUS HAVING SUPPORT MEMBER FOR SUPPORTING EXPOSURE MEMBER

CROSS-REFERENCE TO RELATED APPLICATIONS

This application is based upon and claims priority from Japanese Patent Application No. 2007-309080 filed on Nov. 29, 2007, the entire contents of which are incorporated herein by reference.

TECHNICAL FIELD

The present invention relates to an image forming apparatus that supports an exposure member by means of a rotatable cover.

BACKGROUND

A related-art image forming apparatus is configured to: expose an electrically-charged photoconductive drum to light; forms an electrostatic latent image on the photoconductive drum by changing the electric potential of an exposed area; and transfer to a recording sheet a developer image formed by supplying developer to the electrostatic latent image, thereby recording a predetermined image on the recording sheet.

JP-A-9-160333 describes an image forming apparatus including: a plurality of LED heads (exposure members) configured to radiate light on a plurality of photoconductive drums; and a plurality of process units, each of which includes a photoconductive drum and a toner accommodating chamber, wherein the LED heads and the processes units are alternately arranged in a longitudinal direction. In the image forming apparatus, the LED heads are supported by rotatable top cover and configured to move to and away from the photoconductive drums in association with the rotation of the top cover. A rotation axis of the top cover is rotatably fixed to a rear side portion of an apparatus main body relative to each of the process units, whereby each of the LED heads moves from the front side to the rear side between an exposure position where the photoconductive drum can be exposed and a retracted position where the LED head is retracted from the process unit. Further, the rotation axis of the top cover is situated at substantially the same position (hereinafter called a "head position") of each of the LED heads situated at the exposure position with respect to the vertical direction. Therefore, a tangential line of a locus of the rotation movement of each of the LED heads at the exposure position is oriented substantially upwardly. Accordingly, the respective LED heads are retracted from spaces among the respective process units in a substantially upward direction.

However, in the image forming apparatus, the locus of rotation movement of the LED head assumes the shape of a circular arc. Hence, clearance between the process units is set to a certain size such that the respective LED heads do not interfere with the respective process units. In particular, when the rotation axis of the top cover is set at a position higher than each of the head positions, a tangential line at the exposure position of the locus of rotation movement of each of the LED heads tilts in an obliquely upward direction toward the front, so that the locus of rotation movement of each of the LED heads bulges to the front. Therefore, it is necessary to set the gap between the process units greater. When the rotation axis of the top cover is situated below the head position, a tangential line of the locus of rotation movement of each of the LED heads at the exposure position tilts in an obliquely upward direction toward the rear side, and the rotation locus of the LED head tilts toward the rear side. Therefore, it is necessary to set a gap among the respective process units greater.

SUMMARY

Accordingly, one aspect of the present invention provides an image forming apparatus having reduced size by making a locus of rotation movement of an LED head (an exposure member) appropriate for the layout of another member.

According to an aspect of the invention, there is provide an image forming apparatus comprising: a plurality of process units arranged along a first direction and a second direction opposite to the first direction, each of the process units comprising a photoconductor; a plurality of exposure members configured to expose the respective photoconductors and arranged such that the exposure members and the process units are alternately arranged along the first and second directions; and a support member that supports the exposure members and that is configured to rotate around an axis located in the first direction relative to the exposure members, such that the exposure members are advanced and retracted, in association with a rotation movement of the support member, between an advanced position where the exposure members are respectively advanced into spaces defined between the adjacent process units and a retracted position where all of the plurality of exposure members are retracted from the respective spaces, wherein the support member is configured such that the axis moves along a direction orthogonal to an axial direction of the axis in association with the rotation movement.

According to another aspect of the invention, there is provided an image forming apparatus to which process units are removably attachable, the image forming apparatus comprising: a process unit mounting portion that allows the process units to be mounted such that the process units are arranged along a first direction and a second direction opposite to the first direction, each of the process units comprising a photoconductor; a plurality of exposure members configured to expose the respective photoconductors and arranged such that the exposure members and the process units are alternately arranged along the first and second directions when the process units are mounted to the process unit mounting portion; and a support member that supports the exposure members and that is configured to rotate around an axis located in the first direction relative to the exposure members, such that the exposure members are advanced and retracted, in association with a rotation movement of the support member, between an advanced position where the exposure members are respectively advanced into spaces defined between the adjacent process units and a retracted position where all of the plurality of exposure members are retracted from the respective spaces, wherein the support member is configured such that the axis moves along a direction orthogonal to an axial direction of the axis in association with rotation movement.

According to a still another aspect of the invention, there is provided an image forming apparatus comprising: a photoconductor; an exposure member configured to expose the photoconductor; and a support member that supports the exposure member and that is configured to rotate around an axis, wherein the support member is configured such that the axis moves along a direction orthogonal to an axial direction of the axis in association with a rotation movement of the support member.

DESCRIPTION (First Embodiment)

Figure 1:
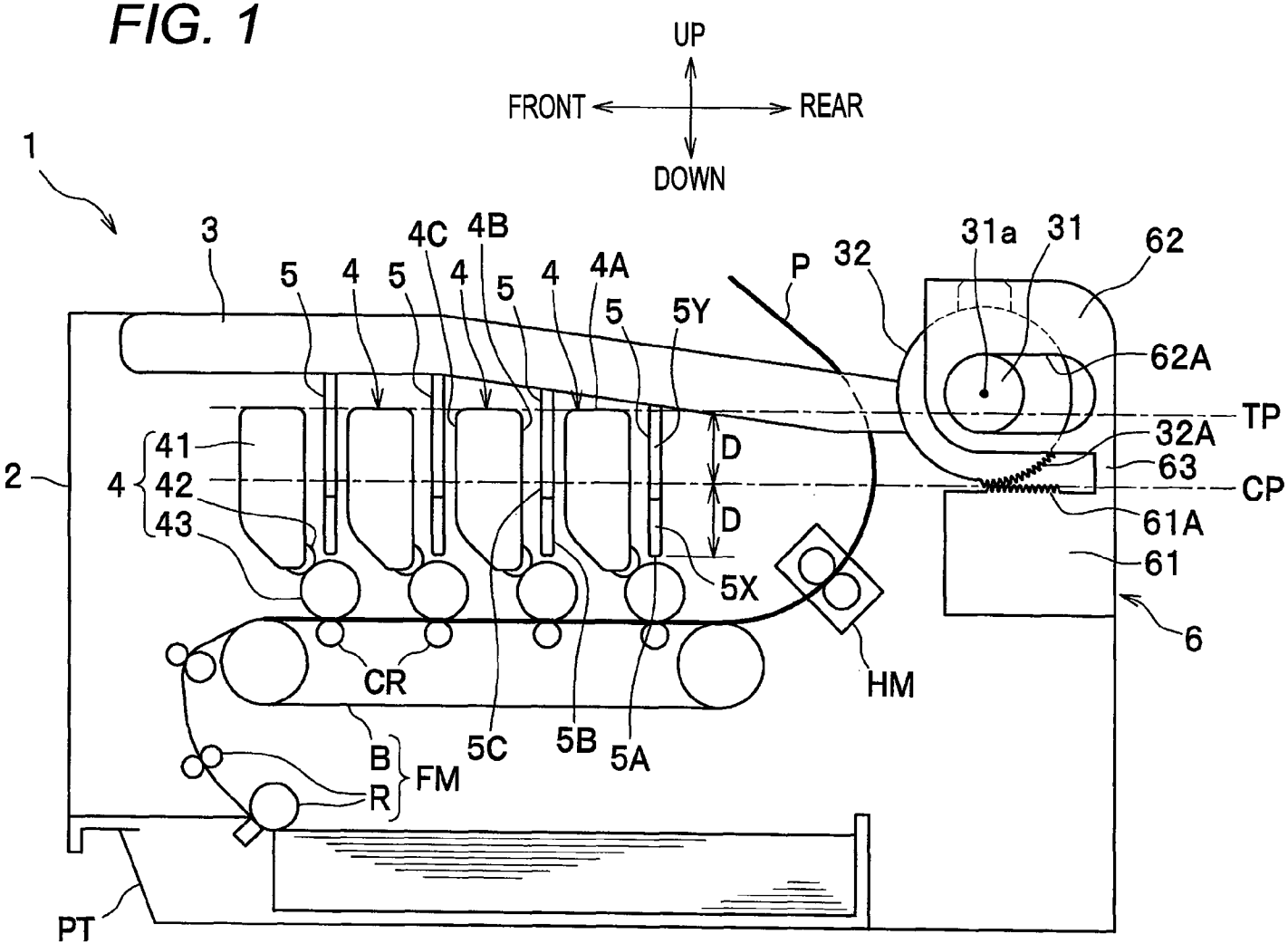
FIG. 1 is a side view showing a color printer of a first embodiment.
Figure 2:
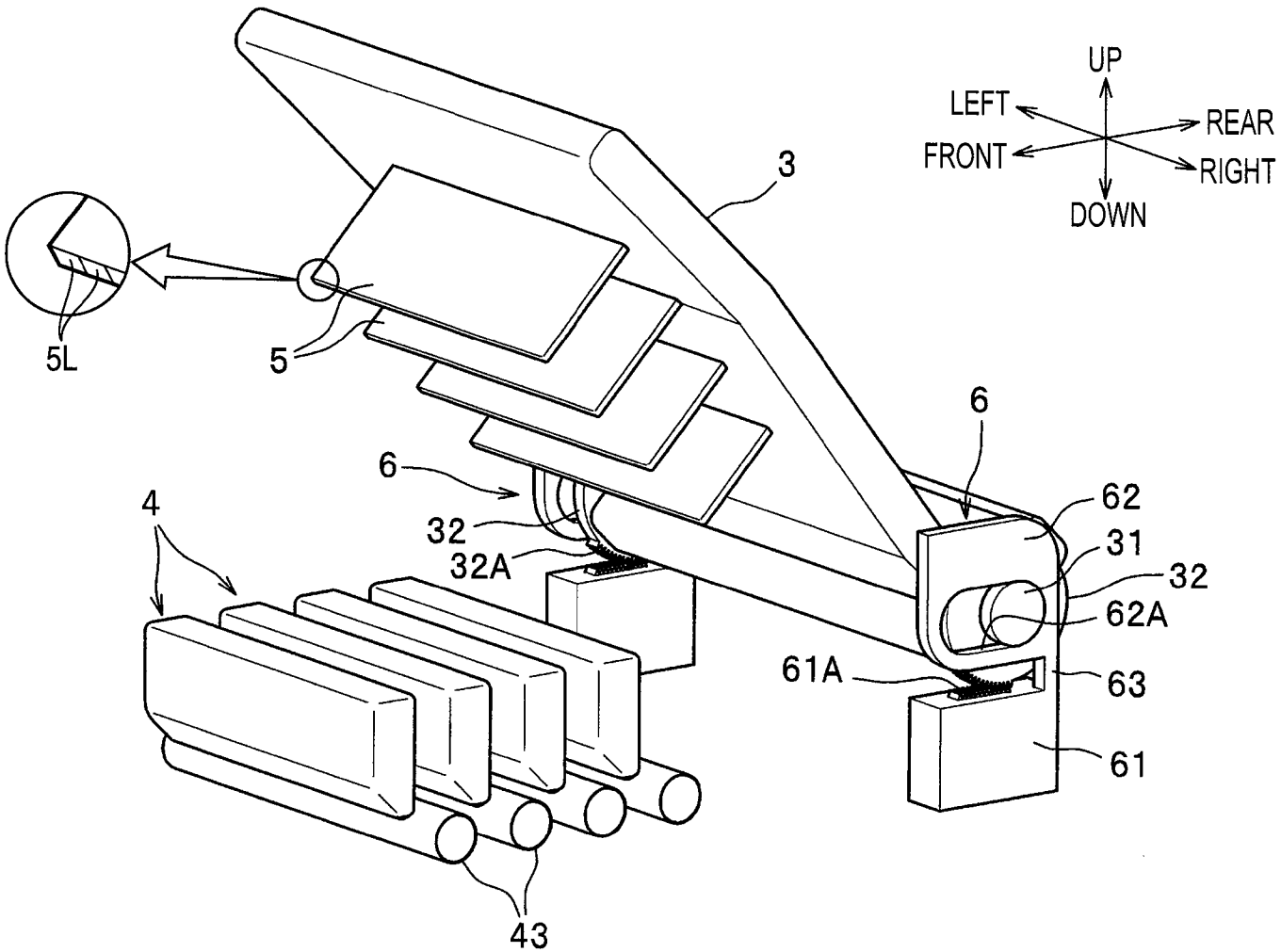
FIG. 2 is a perspective view showing a peripheral structure of a rotation unit of a cover of the color printer.

A first embodiment of the present invention will now be described in detail with reference to the drawings. FIG. 1 is a side view showing a color printer of a first embodiment, and FIG. 2 is a perspective view showing a peripheral structure of a rotation unit of a cover of the color printer. The following descriptions refer to directions viewed from a user during usage of the color printer 1. Specifically, the left side of FIG. 1 is referred to as a "front side"; the right side of the same is referred to as a "rear side"; a distal side of FIG. 1 along the direction perpendicular to a sheet of the drawing is referred to as a "left side"; and a proximal side of FIG. 1 along the direction perpendicular to the sheet is referred to as a "right side." In relation to the vertical direction, the illustrated direction coincides with the direction achieved when the user uses the apparatus, and hence the direction is referred, as it is, to a "vertical direction."

<Color Printer>

As shown in FIG. 1, a color printer 1 serving as an example of the image forming apparatus includes: a substantially box-shaped apparatus main body 2 having an opening provided in a top face thereof; and a cover 3 serving as an example support member configured to open and close the opening of the apparatus main body 2.

<Apparatus Main Body>

The apparatus main body 2 includes: process units 4 which are removably attachable to a process unit mounting portion of the apparatus main body 2; exposure members 5; and axis engagement elements 6 configured to engage with a rotation axis portion 31 of a cover 3. The apparatus main body 2 further includes therein a sheet feed tray PT; a sheet conveyance mechanism FM including a belt B, various rollers R; a transfer roller CR; a fixing device HM; and other elements, such as a sheet discharge mechanism (not shown). In the apparatus main body 2, a sheet P is conveyed by means of the sheet conveyance mechanism FM in order of the sheet feed tray PT, spaces between the respective photoconductive drums 43 and the respective transfer rollers CR, the fixing device HM and the sheet discharge mechanism, and thereafter discharged onto the cover 3.

<Process Unit>

Four process units 4 are spaced apart from one another in a longitudinal direction and accommodate different colors of toner, respectively. Each of the process units 4 includes a developing cartridge 41 having a toner accommodating chamber for accommodating toner defined therein; a developing roller 42 rotatably disposed below the developing cartridge 41; and a photoconductive drum 43 supplied with toner from the developing roller 42. Each of the process units 4 may also be configured such that the developing roller 42 and the photoconductive drum 43 can be separated from each other with a boundary interposed therebetween or such that the developing roller is integrated with the photoconductive drum 43.

The process cartridge 41 further includes a feed roller and a layer thickness regulation blade. Toner in the toner accommodating chamber is supplied to the developing roller 42 by means of the supply roller, and the toner on the developing roller 42 is regulated to a given thickness by means of the layer thickness regulation blade.

The developing roller 42 is configured to supply the photoconductive drum 43 with the toner supplied from the toner accommodating chamber by way of the supply roller and is arranged to contact the photoconductive drum 43.

The photoconductive drums 43 are exposed by the exposure members 5 after electrically charged with respective electrifiers, whereupon electrostatic latent images are formed on the drums 43. The electrostatic latent images formed on the photoconductive drums 43 are supplied with toner from the developing rollers 42, whereby toner images are formed on the respective photoconductive drums 43. The toner images are drawn by transfer rollers CR, to thus be transferred onto the sheet P.

<Exposure Member>

Each exposure member 5 includes: an LED head 5X serving as an example exposure member configured to radiate light used for exposing the photoconductive drum 43; and a connecting portion 5Y that connects a base end side of the LED head 5X to a lower side of the cover 3.

The exposure members 5 and the respective process units 4 are arranged one after the other in the longitudinal direction. Each of the exposure members 5 has a flat shape that extends in both the vertical and horizontal directions (see FIG. 2), and a plurality of LEDs 5L (an array of LEDs 5L) are arranged at distal end of each exposure member 5.

The exposure member 5 has a front surface 5C and a rear surface 5B. When each of the exposure members 5 is situated at the exposure position (i.e., an advanced position where the exposure members 5 are respectively advanced into spaces defined between the adjacent process units 4), the front surface 5C and the rear surface 5B are arranged to extend in the vertical direction. A side surface 4B of the process unit 4 opposing the front surface 5C of the exposure member 5 and a side surface 4C of the process unit 4 opposing the rear surface 5B of the exposure member 5 are arranged so as to extend vertically.

<Axis Engagement Element>

As shown in FIG. 2, two axis engagement elements 6 are respectively disposed on right and left sides of the rear side of the apparatus main body 2. Each of the axis engagement elements 6 includes: a rack 61 including rack teeth 61A formed in an upper surface of the rack; a moving direction regulation portion 62 located above the rack 61; and a connecting portion 63 that connects the rack 61 to the movement direction regulation portions 62. Elongated holes 62A are respectively formed in the moving direction regulation portions 62, which regulate moving directions of the rotation axis portion 31 of the cover 3 to the longitudinal direction (a direction in which the rack teeth 61A is arranged). The axis engagement elements 6 may be formed integrally with the apparatus main body 2 or formed separately from the apparatus main body 2 and fixed. The racks 61 may be separated from the moving direction regulation section 62.

<Cover>

The cover 3 is rotatable around the rotation axis portion 31 formed at a rear end of the cover. More accurately, the cover 3 is rotatable around an axis 31*a* of the rotation axis portion 31. The four exposure members 5 are fixed to the lower surface of the cover 3 and spaced apart from one another other at predetermined intervals. As a result, each of the exposure members 5 can be advanced and retracted, in association with rotation movement of the cover 3, between the exposure position (see FIG. 1) where the photoconductive drum 43 is allowed to be exposed and the retracted position (see FIG. 3E) where all of the exposure members 5 are retracted from the spaces between the adjacent process units 4.

Large diameter portions 32 having larger diameter than the rotation axis portions 31 and concentric with respect to the rotation axis portions 31 are respectively formed at a slightly inner position from the right and left ends of the rotation axis portions 31 of the cover 3. Pinion gears 32A are formed in a lower portion of each of the large diameter portions 32. The pinion gears serve as example of pinion gears that engage the rack teeth 61A of the axis engagement elements 6 from the above when right and left ends of the rotation axis portion 31 are inserted into the elongated holes 62A of the axis engagement elements 6.

Specifically, the pinion gears 32A are disposed to engage the front sides of the respective rack teeth 61A when the respective exposure members 5 are situated at the exposure position (when the cover 3 is closed). According to the pinion gear 32A disposed with respect to the rack teeth 61A as mentioned above, the pinion gears 32A are configured to roll and move rearward when the cover 3 is opened and to roll and move frontward when the cover 3 is closed. The pinion gears 32A may be separate from the rotation axis portion 31.

As shown in FIG. 1, the axis 31*a* of the rotation axis portion 31 of the cover 3 is placed above a center position CP (a position toward which the exposure members 5 are retracted) between upper ends 4A (retracted position side) of the process units 4 and distal ends 5A of the exposure members 5 located at the exposure position. More specifically, the axis 31*a* of the rotation axis portion 31 of the cover 3 is placed above a position TP of the upper ends 4A (the retracted position side) of the process units 4.

The center position CP refers to a position that is vertically spaced the same distance D away from the upper ends 4A of the process units 4 and the distal ends 5A of the exposure members 5 situated at the exposure position.

The expression "the axis 31*a* is placed above the center position CP (or the position TP)" indicates that the axis 31*a* is located above all of the center positions CP (or the positions TP). Specifically, for instance, when the process units 4 are arranged along a direction of obliquely upward or downward, there are a plurality of the center positions CP (or the positions TP) for respective process units 4. In such a case, the axis 31*a* is arranged to be located above all of the center positions CP (or the positions TP). In other words, when the side surfaces 4B and 4C extending substantially along a third direction and a fourth direction opposite to the third direction (upper and lower directions in FIG. 1) on a plane perpendicular to the axis, and the cover 3 moves, with respect to the third and fourth directions, in the third direction (upper direction in FIG. 1) in association with the rotation movement from the exposure position toward the retracted position, the axis is located in the third direction relative to ends (upper surface 4A) of the side surfaces 4B and 4C of the process units 4 or the center position(s) CP.

The axis 31*a* is situated above the position TP. If the rotation axis portion 31 (the axis 31*a*) does not move in the direction orthogonal to the axis 31*a*, the locus of an area of each exposure member 5 (the front surface 5C) located below the position TP (i.e., (the locus of an area overlapping the corresponding process unit 4 in the horizontal direction) plots a circular-arc path bulging frontward when the exposure member 5 moves from the exposure position (see FIG. 4B).

Figure 3A:
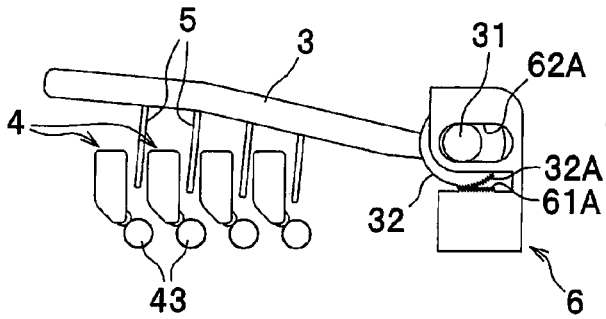
FIGS. 3A to 3D are side views showing respective stages achieved when a fully-closed cover is opened in increments of predetermined angles.
Figure 3D:
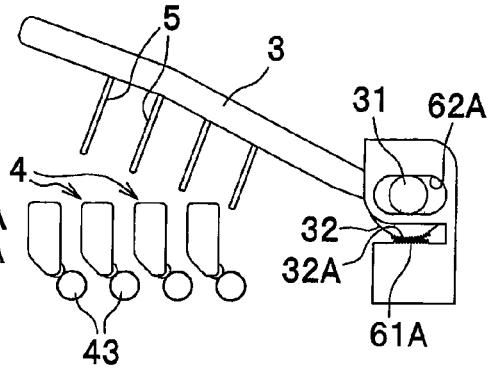
Figure 3E:
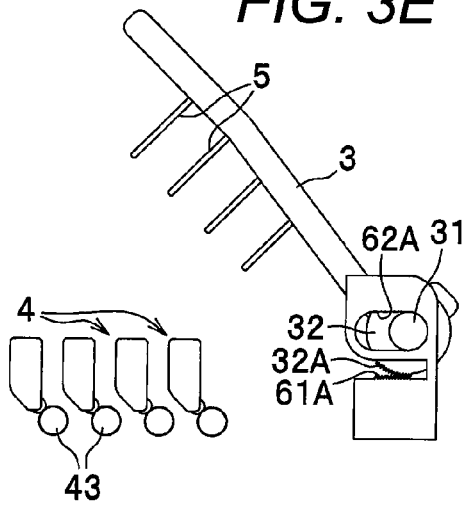
FIG. 3E is a side view showing the state of the cover 3 when the cover is opened to a retracted position.
Figure 3B:
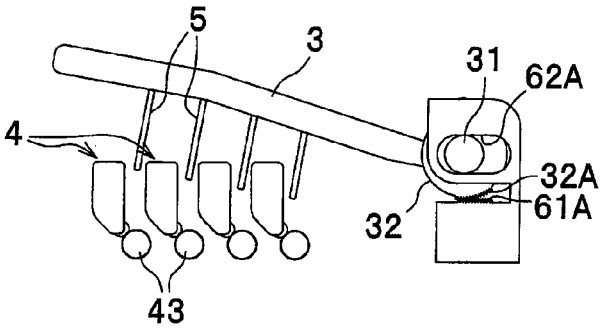
Figure 3C:
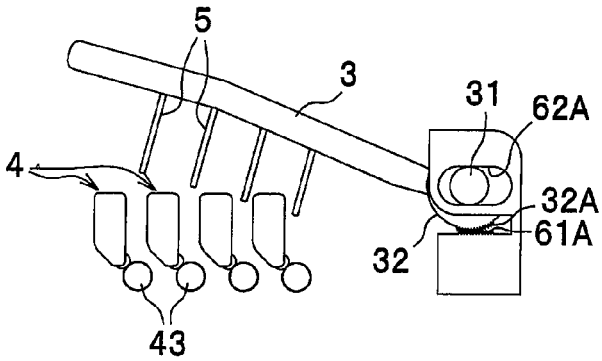
Figure 4A:
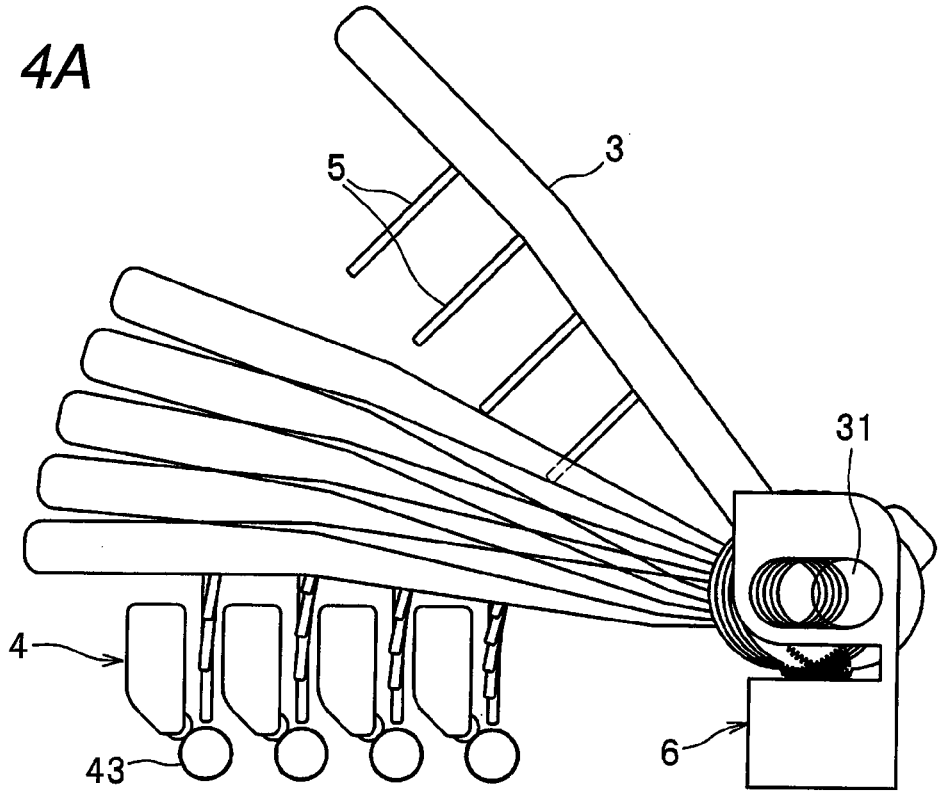
FIG. 4A is a side view showing loci of rotation movements of the respective exposure members achieved in the first embodiment.
Figure 4B:
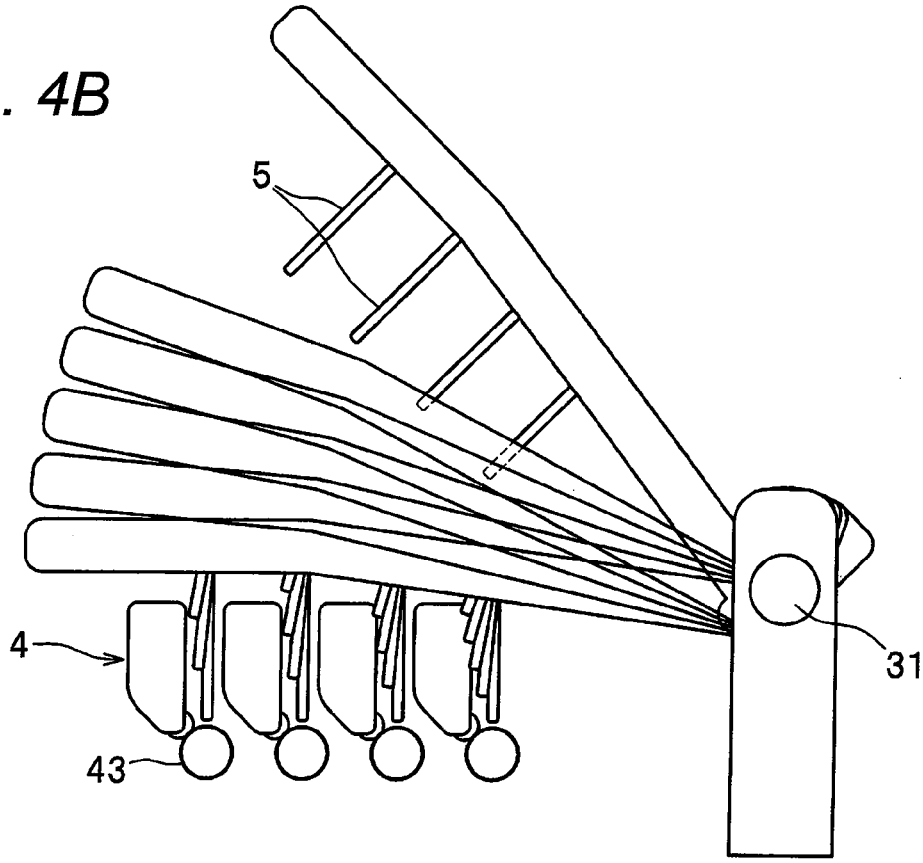
FIG. 4B is a side view showing loci of rotation movements of the respective exposure members of the related art in which the rotation unit is fixed.

Movement of the rotation axis portion 31 associated with opening and closing actions of the cover 3 will now be described by reference to FIGS. 3A to 3E and FIGS. 4A and 4B. FIGS. 3A to 3D are side views showing respective stages when a fully-closed cover is opened in increments of predetermined angles, and FIG. 3E is a side view showing the state of the cover 3 when the cover is opened to the retracted position. FIG. 4A is a side view showing loci of rotation movements of the respective exposure members achieved in the first embodiment, and FIG. 4B is a side view showing loci of rotation movements in case where the rotation axis portion is fixed (a structure in which the rotation axis portion is unmovable in a direction orthogonal to the axis).

As sequentially shown in FIGS. 3A to 3E, when the cover 3 is opened, pinion gears 32A of the large diameter portions 32 of the cover 3 move rearward by rolling over the rack teeth 61A, whereby the rotation axis portion 31 moves from the front side to the rear side along the elongated holes 62A. Conversely, when the cover 3 is closed from the state shown in FIG. 3E, the pinion gears 32A of the large diameter portions 32 of the cover 3 move by rolling over the rack teeth 61A frontward in sequence shown in FIGS. 3D to 3A, whereby the rotation axis portion 31 moves from the rear side to the front side along the elongated holes 62A.

As a result, as shown in FIG. 4A, the loci of rotation movements of the exposure members 5 assume a gentle circular-arc path along an essentially-vertical direction. Specifically, as shown in FIG. 4B, in case where the rotation axis portion 31 is fixed (unmovable in an axial direction), the loci of rotation movements of areas of the respective exposure members 5 (the front surfaces 5C) located below the position TP assume a circular-arc shape that bulges frontward from the exposure position and that has a small diameter and a large curvature radius. In contrast, in the present embodiment, the loci of rotation movements assume a circular-arc shape that is gentler than that of the fixed-axis structure (has a smaller curvature radius than that of the loci of rotation movements of the fixed-axis structure), thereby preventing frontward bulging of the loci of the respective exposure members 5 (the front surfaces 5C) located below the position TP.

As described above, the first embodiment can provide the following advantages.

In the mode where the axis 31*a* is disposed above the position TP of the upper ends 4A of the respective process units 4, the rotation axis portion 31 is arranged to move rearward in association with releasing of the cover 3. Hence, as compared with the structure where the rotation axis portion 31 is fixed, frontward bulging of the rotation movement of the respective exposure members 5 can be prevented, and the loci of rotation movements of the respective exposure members 5 can be closer to a straight line. Therefore, the pitches between the respective process units 4 can be made narrower, which allows the reduction of the size of the image forming apparatus.

Further, since the rotation axis portion 31 is configured to move longitudinally in association with rotation movement of the cover 3, amounts of upward movement of the cover 3 can be reduced. A location where the color printer 1 is disposed can be set in a comparatively free manner. The rotation axis portion 31 may move along the vertical direction in association with the rotation movement of the cover 3, which also allows the loci of rotation movements of the exposure members closer to a straight line. In this case, however, the vertical movement of the rotation axis requires a larger upper space required for opening the cover 3 than the horizontal movement.

A simple structure primarily utilizing the pinion gears 32A and the rack teeth 61A is adopted as a structure for moving the rotation axis portion 31, which allows the reduction of the size of the image forming apparatus.

(Second Embodiment)

Figure 5:
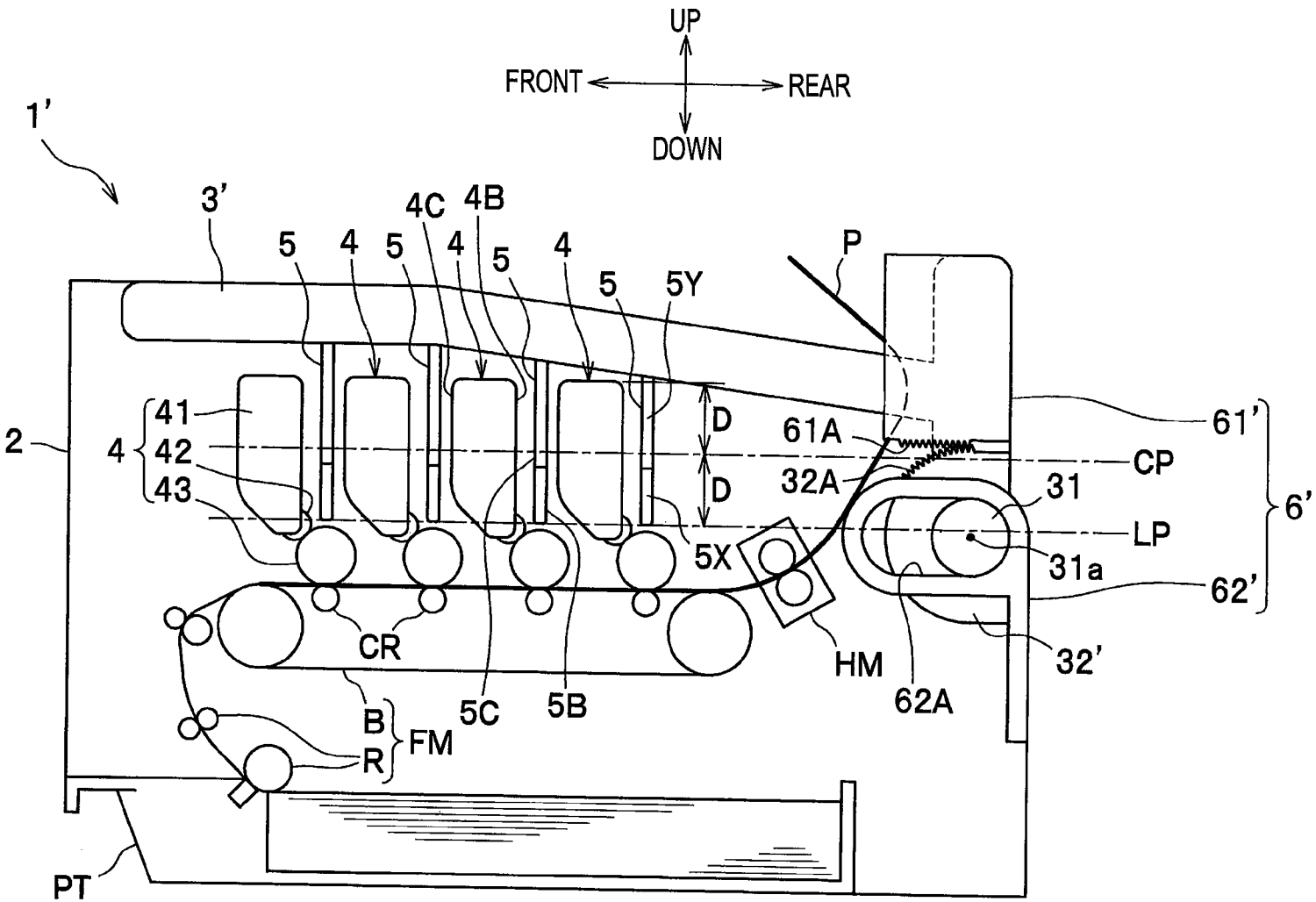
FIG. 5 is a side view showing a color printer of a second embodiment.
Figure 7:
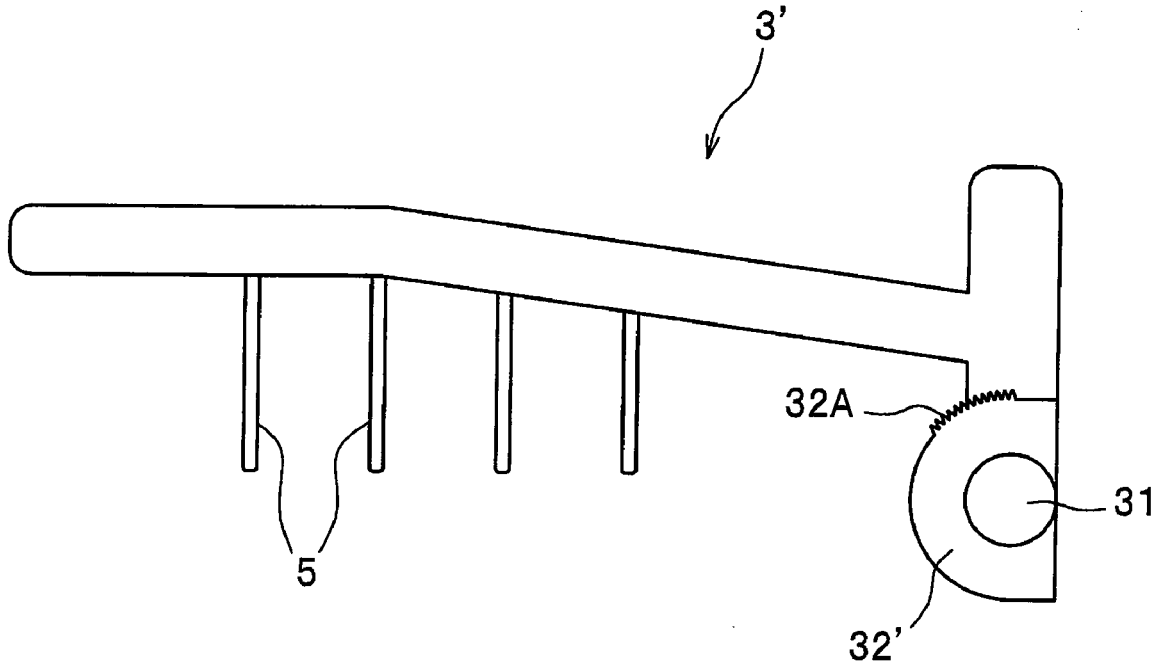
FIG. 7 is a side view showing the cover.
Figure 8A:
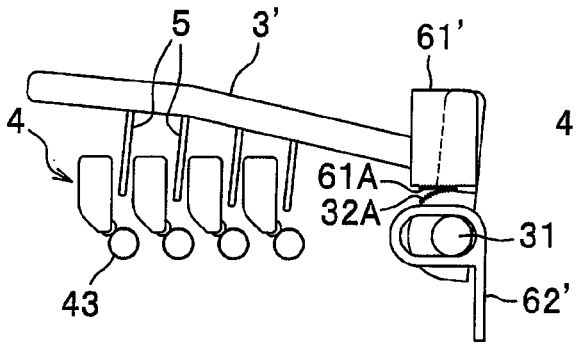
FIGS. 8A to 8D are side views showing respective stages achieved when a fully-closed cover is opened in increments of a predetermined angle.
Figure 8D:
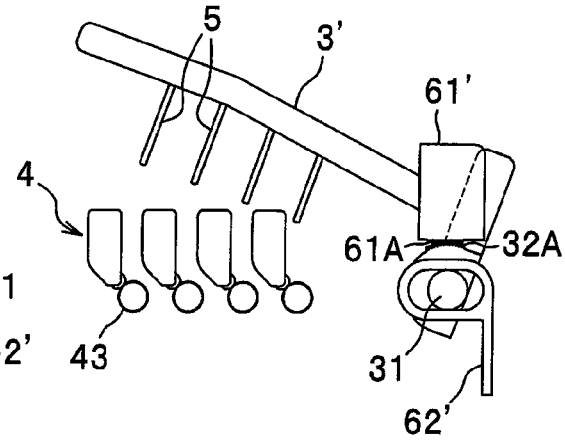
Figure 8B:
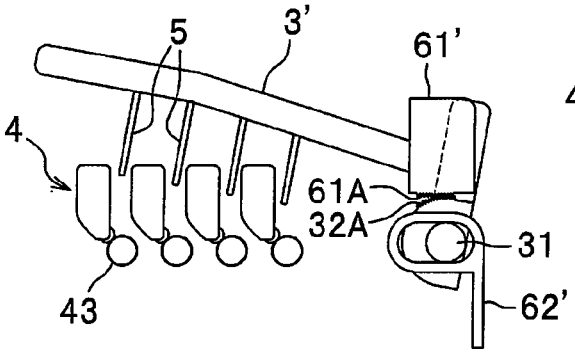
Figure 8E:
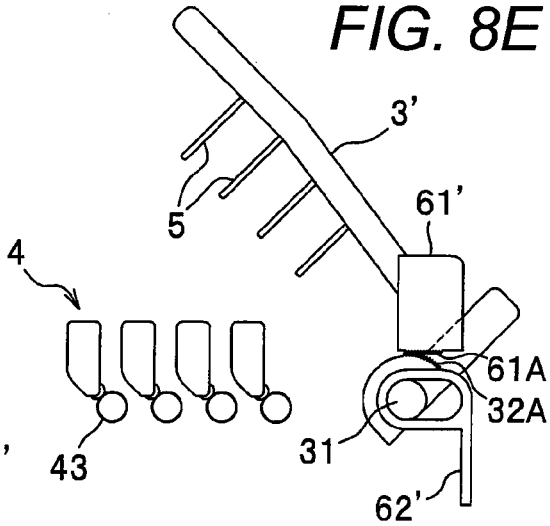
FIG. 8E is a side view showing the cover opened to the retracted position.
Figure 8C:
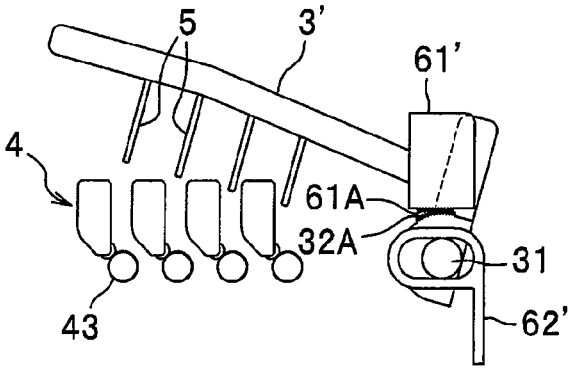

A second embodiment of the present invention will now be described in detail by reference to the drawings. The present embodiment is directed to an alteration to a peripheral structure of the previously-described rotation axis portion 31 of the first embodiment. Therefore, elements which are analogous to those described in connection with the first embodiment are assigned the same reference numerals, and their explanations are omitted. FIG. 5 is a side view showing a color printer of a second embodiment, FIG. 6 is a perspective view showing the peripheral structure of the rotation axis portion of the cover, FIG. 7 is a side view showing the cover, FIGS. 8A to 8D are side views showing respective stages achieved when a fully-closed cover is opened in increments of a predetermined angle, and FIG. 8E is a side view showing the cover opened to the retracted position.

As shown in FIG. 5, a color printer 1' of the second embodiment includes axis engagement elements 6' and a cover 3', which are different from the first embodiment. The exposure member 5 and the process unit 4 have the same configurations as those of the first embodiment.

Specifically, each of the exposure members 5 has the front surface 5C and the rear surface 5B. When the exposure member 5 is situated at the exposure position, the front surface 5C and the rear surface 5B extend downwardly. The side surface 4B of the process unit 4 opposing the front surface 5C of the exposure member 5 and the side surface 4C of the process unit 4 opposing the rear surface 5B of the exposure member 5 extend vertically.

Figure 6:
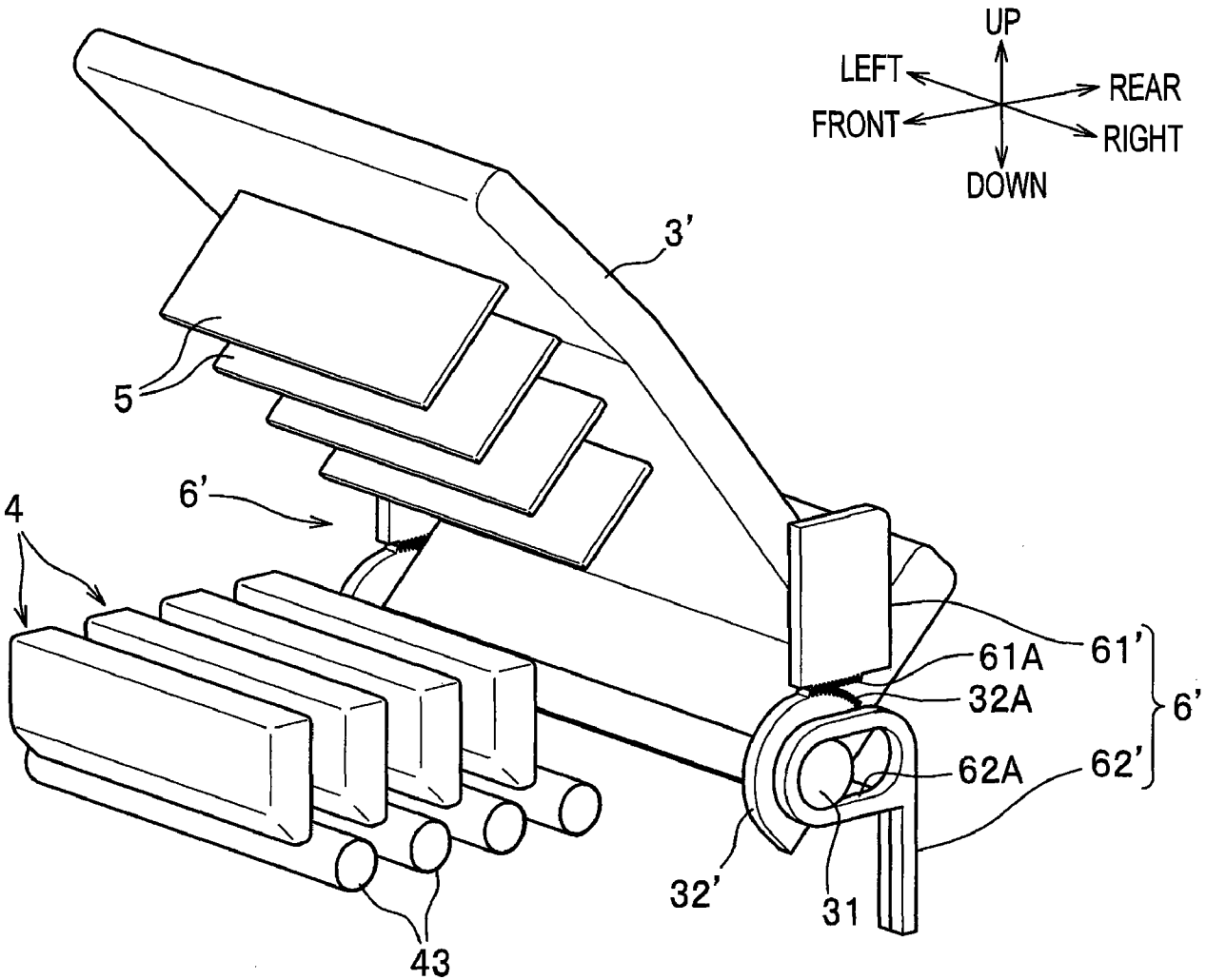
FIG. 6 is a perspective view showing the peripheral structure of the rotation unit of the cover.

As shown in FIG. 6, each of the axis engagement elements 6' includes: a rack 61' including the rack teeth 61A formed in a lower surface of the rack; and a moving direction regulation portion 62' located below the rack 61'. The elongated hole 62A similar to the first embodiment is formed in each moving direction regulation portion 62'.

As shown in FIG. 5, the rotation axis portion 31 of the cover 3' is arranged below the center position CP (a side where the exposure members 5 are advanced toward the photoconductive drums 43). In particular, in the present embodiment, the axis 31*a* of the rotation axis portion 31 is situated below a distal end position LP of each of the exposure members 5.

The expression "the axis 31*a* is situated beneath the center position CP (or the distal end position LP)" indicates that the axis 31*a* is situated below all of the center positions CP (or the distal end positions LP). Specifically, for instance, when the process units 4 are arranged obliquely upward or downward, there are a plurality of the center positions CP (or the distal end positions LP) for respective process units 4. In such a case, the axis 31*a* is located below all of the center positions CP (or the distal end positions LP). In other words, when each of the process units 4 has a surface (side surfaces 4B and 4C) extending substantially along a third direction and a fourth direction opposite to the third direction on a plane perpendicular to the axis (upper and lower directions in FIG. 5) and the support member is configured to move, with respect to the third and fourth directions, in the third direction in association with the rotation movement from the exposure position toward the retracted position, the axis is located in the fourth direction relative to the exposure members of the process units 4.

The axis 31*a* is situated below the distal end position LP. When the rotation axis portion 31 is fixed and does not move in a direction perpendicular to the axial direction, the locus of an area of each exposure member 5 located below the distal end position LP (i.e., the locus of an area overlapping the corresponding process unit 4 in the horizontal direction) plots a circular-arc path bulging rearward in association with rotation movement.

As shown in FIGS. 6 and 7, a substantially semicircular large diameter portion 32' that has larger diameter than the rotation axis portion 31 and concentric with respect to the rotation axis portion 31 is formed at a slightly inner position from right and left ends of the rotation axis portion 31 of the cover 3'. The pinion gears 32A that engage the rack teeth 61A of the axis engagement elements 6' from below are formed in upper portions of the respective large diameter portions 32'. Specifically, the pinion gears 32A are configured to engage with rear-side portions of the rack teeth 61A at the exposure position, as shown in FIG. 5. According to the pinion gears 32A arranged with respect to the rack teeth 61A as mentioned above, the pinion gears 32A roll and move frontward when the cover 3' is opened, and the pinion gears 32A roll and move rearward when the cover 3' is closed, as shown in FIGS. 8A to 8E.

Figure 9A:
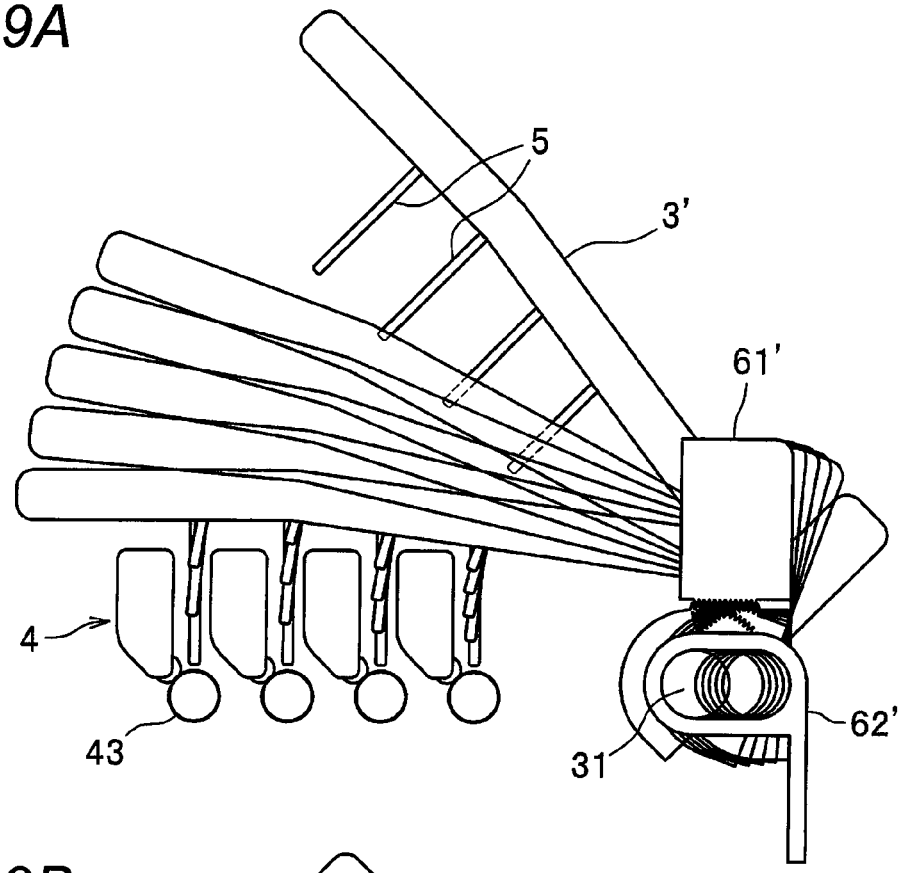
FIG. 9A is a side view showing loci of rotation movements of the exposure members of the second embodiment.
Figure 9B:
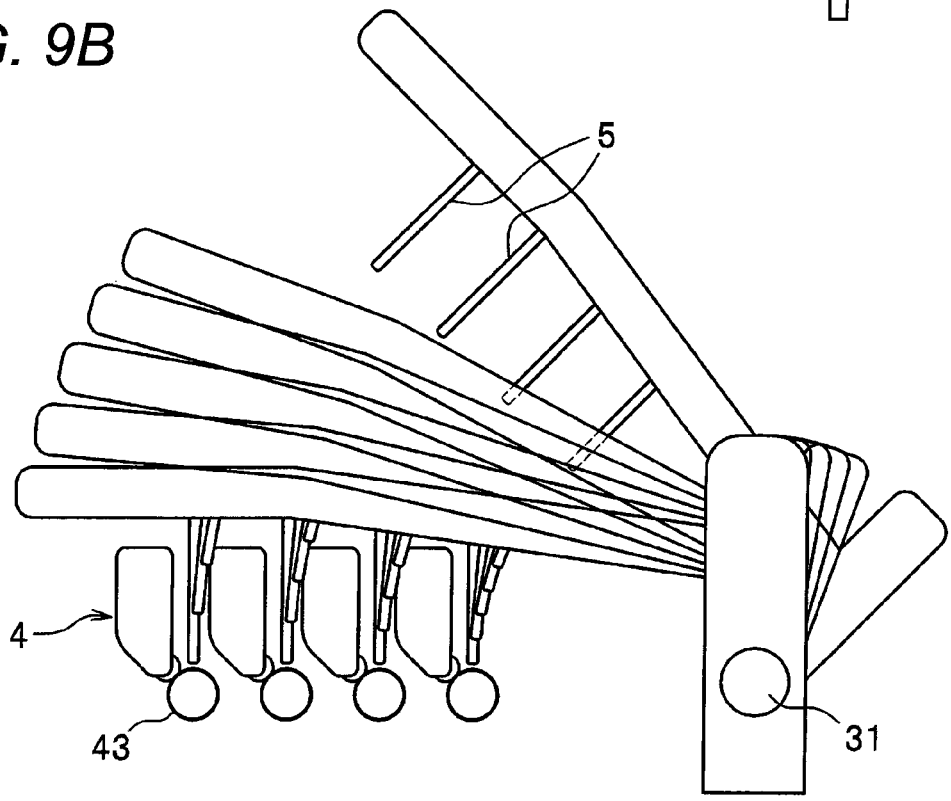
FIG. 9B is a side view showing loci of rotation movements of related-art exposure members in which the rotation unit is secured.

Moving loci of the respective exposure members 5 of the cover 3' of the second embodiment will now be described by reference to FIGS. 9A and 9B. FIG. 9A is a side view showing loci of rotation movements of the exposure members of the second embodiment, and FIG. 9B is a side view showing loci of rotation movements of exposure members in which the rotation axis portion is fixed.

As shown in FIG. 9A, in the second embodiment, the loci of rotation movements of the exposure members 5 assume a gentle circular-arc path along the substantially vertical direction. Specifically, as shown in FIG. 9B, in case where the rotation axis portion 31 is fixed, the respective exposure members 5 move along circular-arc, small-diameter paths that involve large amounts of movement from the exposure positions rearward. In contrast, in the present embodiment, the loci of rotation movements assume a circular-arc shape that is gentler than the loci of rotation movements of FIG. 9A, so that amounts of movement of the respective exposure members 5 rearward can be reduced.

As described above, the second embodiment can yield the following advantages.

In the mode where the rotation axis portion 31 is disposed below the center position CP, the rotation axis portion 31 is moved frontward in association with opening the cover 3'. Hence, amounts of rearward movement of the respective exposure members 5 are reduced, and the loci of rotation movements of the respective exposure members 5 can be made close to a straight line. Therefore, the pitches between the respective process units 4 can be made narrower, which allows the reduction of size of the image forming apparatus.

Further, since the rotation axis portion 31 is configured to move frontward and rearward in association with rotation movement of the cover 3', amounts of upward movement of the cover 3' can be reduced. A location where the color printer 1 is disposed can be set in a comparatively free manner.

(Third Embodiment)

Figure 10A:
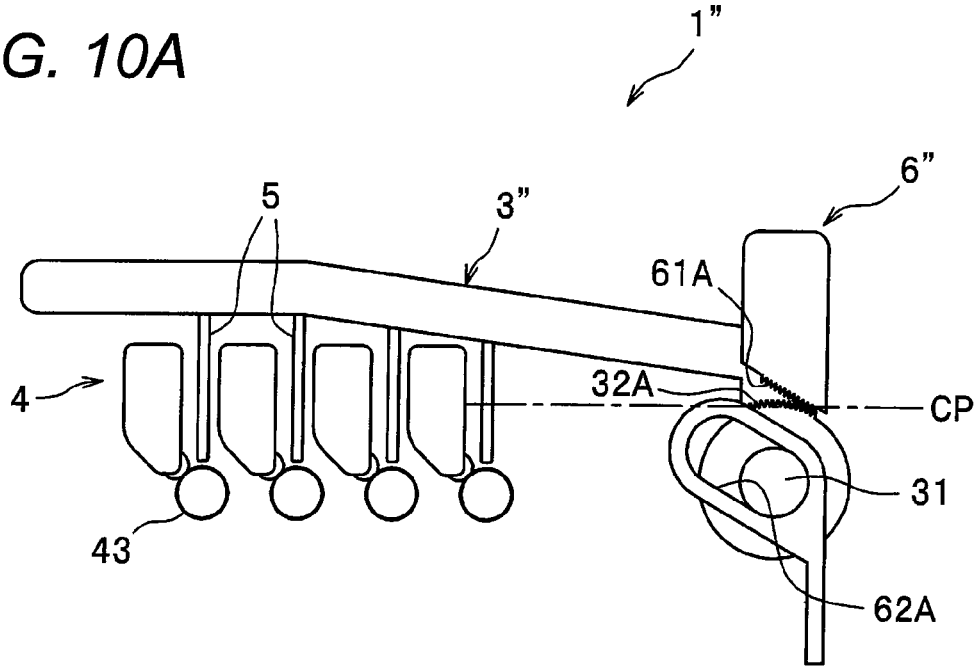
FIG. 10A is a side view showing a color printer of a third embodiment.
Figure 10B:
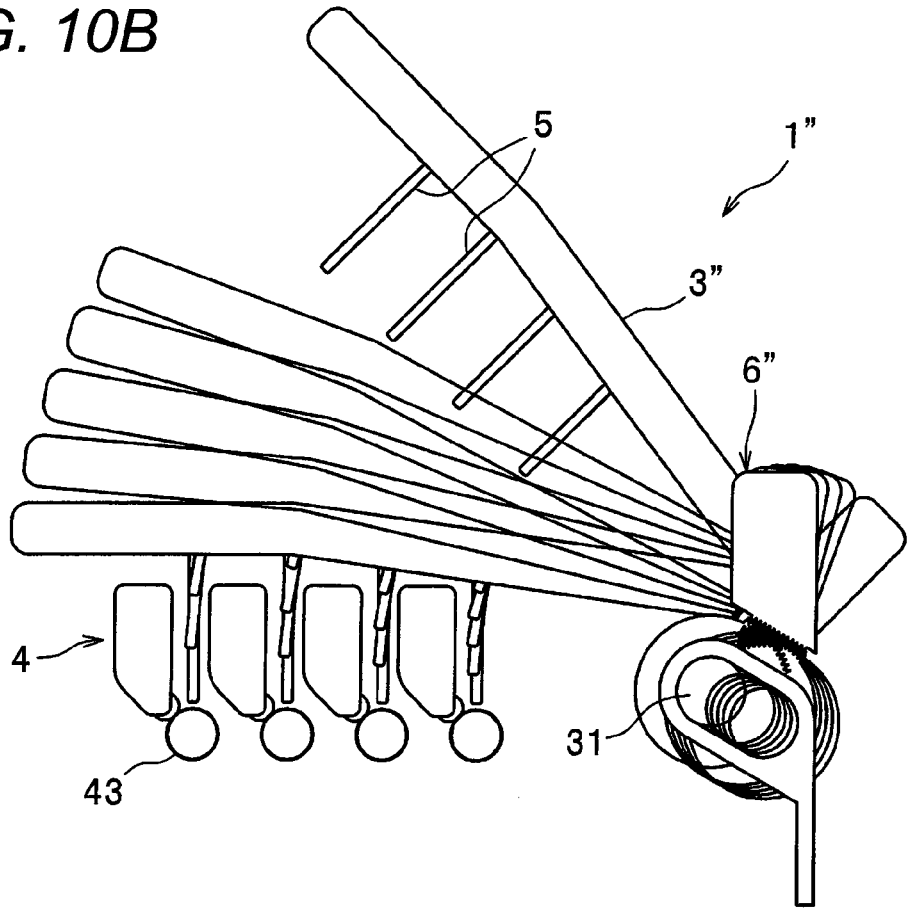
FIG. 10B is a side view showing loci of rotation movements of exposure members of a third embodiment.

A third embodiment of the present invention will now be described in detail by reference to the drawings. The present embodiment is directed to an alteration to a peripheral structure of the previously-described rotation axis portion of the second embodiment. Therefore, elements which are analogous to those described in connection with the second embodiment are assigned the same reference numerals, and their explanations are omitted. FIG. 10A is a side view showing a color printer of a third embodiment, and FIG. 10B is a side view showing loci of rotation movements of exposure members of the third embodiment.

As shown in FIG. 10A, a color printer 1" of the third embodiment is different from the color printer of the second embodiment in that a direction in which the rack teeth 61A of axis engagement elements 6" are arranged and the direction of a major axis of the elongated holes 62A are oriented in an oblique direction that tilt from the rotation axis portion 31 toward an upper oblique front side. The pinion gear 32A of the cover 3" is different from the second embodiment in that the pinion gear is formed at a position where, at the exposure position, the pinion gear meshes the obliquely-inclined rack teeth 61A from below and meshes a rear side of the rack teeth 61A. Specifically, in the present embodiment, the rotation axis portion 31 is movable in the longitudinal direction as well as in the vertical direction (the direction from the exposure position to the retracted position).

According to the rack teeth 61A and the elongated holes 62A directed obliquely, the rotation axis portion 31 moves in an upper oblique, frontward direction as the cover 31" is opened. As the cover 3" is closed, the rotation axis portion 31 moves in a downwardly oblique, rearward direction. Thus, as shown in FIG. 10B, the loci of rotation movements of the respective exposure members 5 assume a circular-arc shape that is gentler than the second embodiment (see FIG. 9A).

As described above, the third embodiment can yield the following advantages.

In the mode where the rotation axis portion 31 is disposed below the center position CP, the rotation axis portion 31 is moved in an upper obliquely, frontward direction in association with releasing of the cover 3". Hence, amounts of rearward movement of the respective exposure members 5 are reduced, and the respective exposure members 5 can quickly retracted from spaces between the respective process units 4. Therefore, the loci of rotation movements of the respective exposure members 5 can be made close to a straight line, and the pitches between the respective process units 4 can be made narrower, which allows the reduction of the size of the image forming apparatus.

The present invention is not limited to the embodiments and can be in various forms as exemplified below.

In the first embodiment, the axis 31*a* of the rotation axis portion 31 of the cover 3 is disposed higher than the position TP of the upper ends 4A of the process units 4. However, the present invention is not limited to the embodiment. For instance, the axis 31*a* may also be disposed below the position TP of the upper ends 4A of the process units 4 at a location higher than the center position CP (the side to which the exposure members 5 are retracted).

In such a configuration, if the rotation axis portion 31 (the axis 31*a*) does not move in the direction orthogonal to the axis 31*a*, areas of the exposure members 5 located below the axis 31*a*, in areas of the exposure members 5 located below the position TP of the upper ends of the process units 4, assume a frontward bulging path as the cover 3 is opened. Further, as the cover 3 is opened, areas of the exposure members 5 located above the axis 31*a* assume a path tilting rearward. Specifically, the exposure members 5 plot such a circular-arc path that amounts of frontward displacement of the areas of the exposure members 5 located below the axis 31*a* become greater than amounts of rearward displacement of the areas of the exposure members 5 located above the axis 31*a*.

In contrast, when the rotation axis portion 31 is moved rearward in association with releasing of the cover 3, amounts of frontward displacement of the respective exposure members 5 (the areas of the exposure members located below the axis 31*a*) can be reduced when compared with the fixed rotation axis portion, and hence the loci of rotation movements of the respective exposure members 5 can be made close to a straight line, and the pitches between the respective process units 4 can be made narrower, which allows the reduction of the size the image forming apparatus.

In the second embodiment, the axis 31*a* of the rotation axis portion 31 of the cover 3 is located below the distal end position LP of the exposure members 5. However, the present invention is not limited thereto. For instance, the axis 31*a* may also be placed above the distal end position LP of the exposure members 5 but lower than the area of the center position CP (where the exposure members 5 perform advancement).

In such a configuration, if the rotation axis portion 31 (the axis 31*a*) does not move in the direction orthogonal to the axis 31*a*, areas of the exposure members 5 located below the axis 31*a*, in areas of the exposure members 5 located below the position TP of the upper ends of the process units 4, assume a frontward bulging path as the cover 3 is opened. Further, as the cover 3 is opened, areas of the exposure members 5 located above the axis 31*a* assume a path tilting toward the deep interior position. Specifically, the exposure members 5 plot such a circular-arc path that amounts of rearward displacement of the areas of the exposure members 5 located above the axis 31*a* become greater than amounts of forward displacement of the areas of the exposure members 5 located below the axis 31*a*.

In contrast, when the rotation axis portion 31 is moved frontward in association with releasing of the cover 3, amounts of rearward displacement of the respective exposure members 5 (the areas of the exposure members located above the axis 31*a*) can be reduced when compared with the fixed rotation axis portion, and hence the loci of rotation movements of the respective exposure members 5 can be made close to a straight line, and the pitches between the respective process units 4 can be made narrower, which allows the reduction of the size of the image forming apparatus.

Figure 11A:
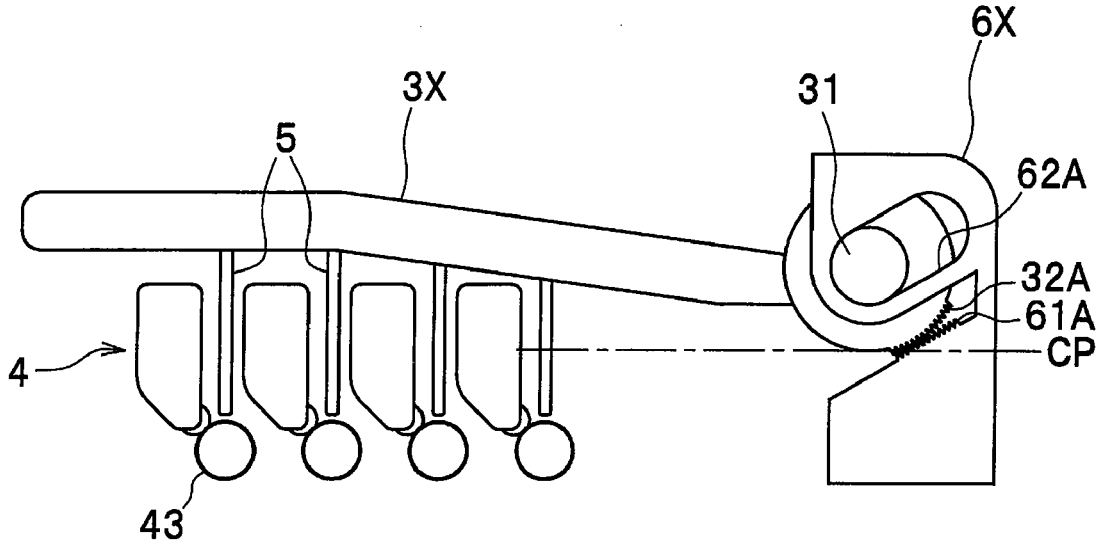
FIG. 11A is a side view showing a color printer of a modification of the first embodiment.
Figure 11B:
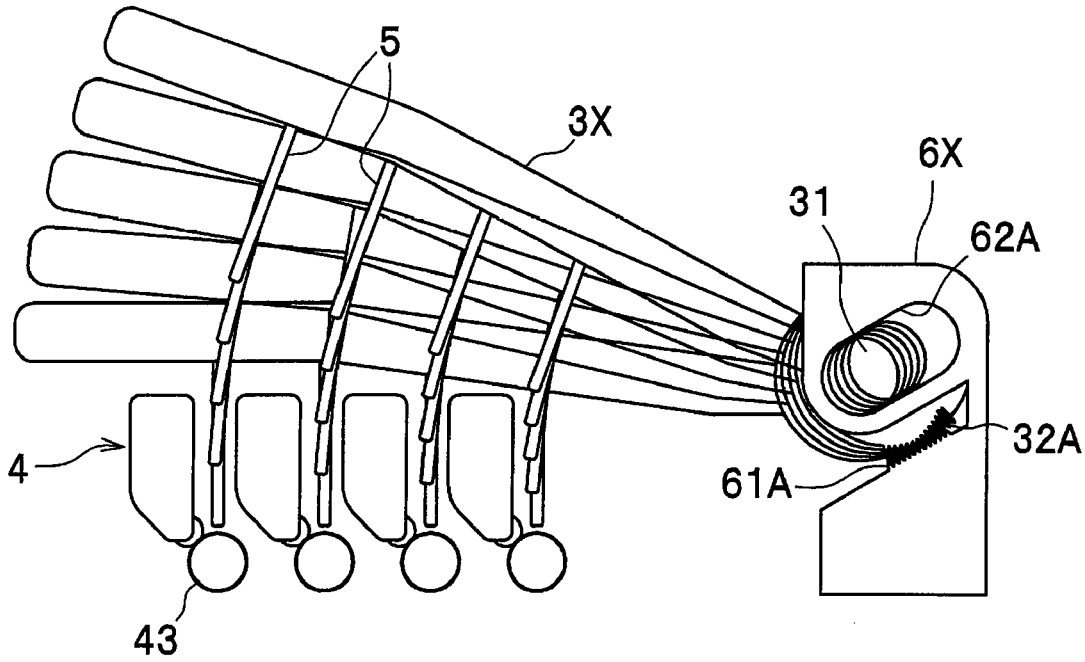
FIG. 11B is a side view showing loci of rotation movements of exposure members of the modification.

In the third embodiment, in the mode where the rotation axis portion 31 is disposed below the center position CP, the rotation axis portion 31 is moved upward as well as frontward in association with opening the cover 3". However, the present invention is not limited thereto. For instance, as shown in FIGS. 11A and 11B, in the mode where the rotation axis portion 31 is disposed above the center position CP as in the first embodiment, the rotation axis portion 31 may also be configured to move upward as well as rearward in association with opening of the cover 3X. Specifically, the pinion gears 32A are configured to mesh a front side portion of the rack teeth 61A at the exposure position by arranging the rack teeth 61A of axis engagement elements 6X in an oblique, upper, rear direction and arranging the major axes of the elongated holes 62A in the oblique, upper, rear direction. As a result, the loci of rotation movements of the respective exposure members 5 can be made closer to a straight line than in the first embodiment, and the pitches between the respective process units 4 can be made narrower, which allows the reduction of the size of the image forming apparatus.

Figure 12:
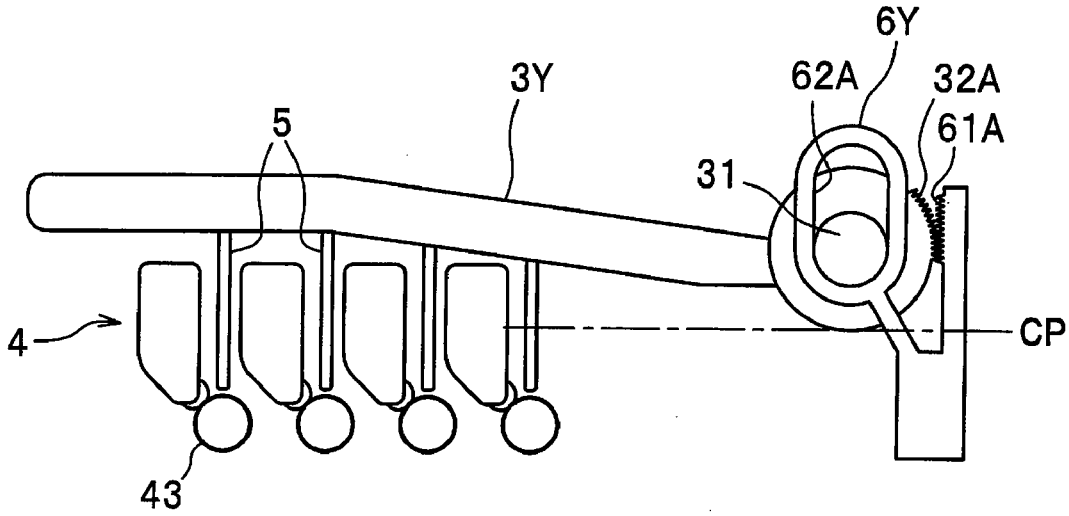
FIG. 12 is a side view showing a mode in which the rotation unit is moved in only a vertical direction.
Figure 13A:
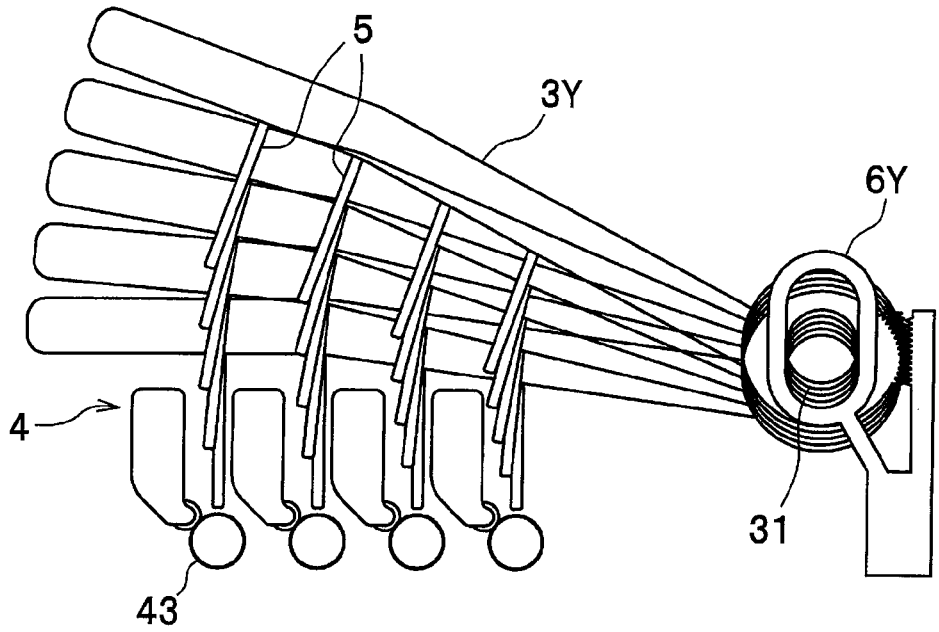
FIG. 13A is a side view showing loci of rotation movements of the exposure members of the embodiment shown in FIG. 12.
Figure 13B:
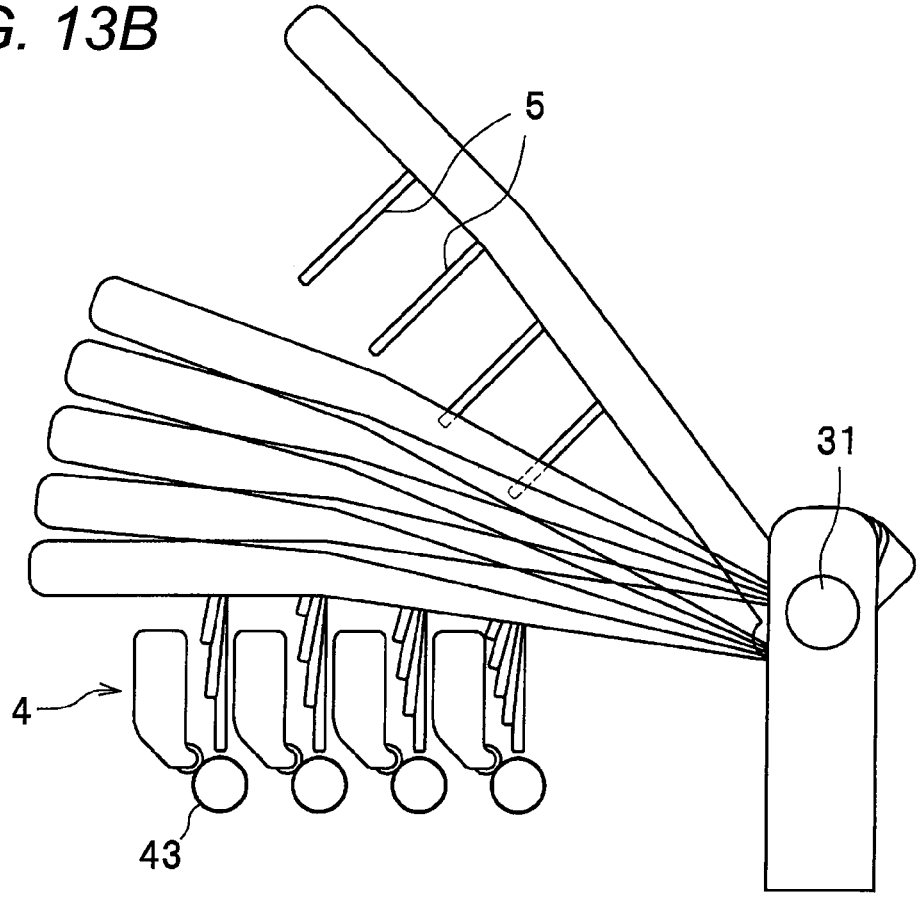
FIG. 13B is a side view showing loci of rotation movements of related-art exposure members in which the rotation unit is secured.

Although the rotation axis portion 31 is configured to move in at least the longitudinal direction in the respective embodiments, the present invention is not limited thereto. For example, the rotation axis portion 31 may also be configured to move in only the vertical direction. Specifically, as shown in FIG. 12, in a mode where the rotation axis portion 31 is situated above the center position CP, the rack teeth 61A of axis engagement elements 6Y and the direction of the major axes of the elongated holes 62A are arranged in the vertical direction. Further, the distal ends of the respective rack teeth 61A are oriented forwardly. Moreover, the pinion gears 32A of the cover 3Y are formed at a position where the pinion gears can mesh the rack teeth 61A from the front and where the pinion gears can mesh the lower sides of the rack teeth 61A at the exposure position. As described above, when compared with the structure shown in FIG. 13B where the rotation axis portion 31 is fixed, the frontward bulges of the locus of respective exposure members 5 are slightly reduced as shown in FIG. 13A.

Therefore, when compared with the fixed-axis structure, the loci of rotation movements of the respective exposure members 5 become closer to a straight line, and the size of the printing apparatus can be reduced by narrowing the intervals among the respective process units 4. Moreover, the rotation axis portion 31 moves upward (toward the retracted position) in association with rotation movement. Hence, the exposure members 5 can be caused to be retracted from the spaces among the process units 4 with involvement of smaller amounts of rotation movement than those in the fixed-axis structure. Consequently, bulges of the loci of the exposure members 5 achieved when portions of the exposure members 5 are situated below the position TP can be reduced.

Although the present invention is applied to the color printer 1 in the respective embodiments, the present invention is not limited to the printer but may also be applied to another image forming apparatus; for instance, a copier or a multi-function machine.

The LED head 5X is adopted as the exposure member in the respective embodiments. However, the present invention is not limited to the LED head. For instance, a plurality of light-emitting elements, such as EL (electroluminescence) elements and fluorescent elements, may be arranged, and the light-emitting elements may be selectively caused to illuminate in accordance with image data. Further, a plurality of optical shutters formed from liquid-crystal elements or PLZTs may be arranged, and light from a singular light source or multiple light sources may be controlled by selective control of open and close periods of the optical shutters in accordance with image data.

Although the photoconductive drum is adopted as a photoconductor in the respective embodiments, the present invention is not limited to the photoconductive drum, and a belt-shaped photoconductor may also be adopted.

Although the covers 3, 3', . . . , are adopted as the support member in the respective embodiments, the present invention is not limited to the covers. For instance, a rotatable support frame secured in the image forming apparatus and separately from the cover may also be adopted.

Figure 14:
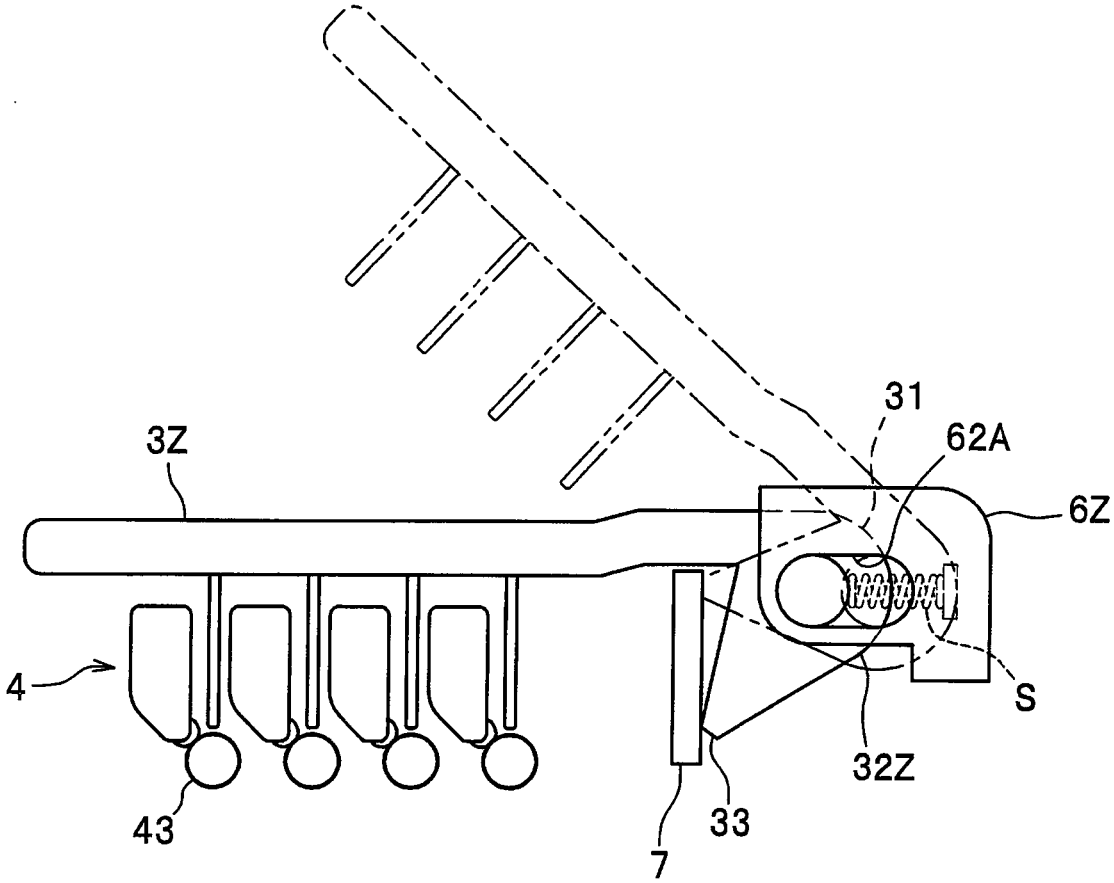
FIG. 14 is a side view showing a modification of the structure where the rotation unit is moved.

In the respective embodiments, the rotation axis portion 31 is configured to move in the direction orthogonal to the axial direction by means of the pinion gears 32A and the rack teeth 61A. However, the present invention is not limited thereto, and any structure may also be adopted to move the rotation axis portion 31, so long as the structure enables movement of the rotation axis portion 31. For instance, as shown in FIG. 14, portions of large diameter sections 32Z of a cover 3Z may protrude outwardly in a radial direction, and protruded distal ends 33 may press a rear surface of a wall 7 fixed to the apparatus main body 2. In this case, each of the axis engagement elements 6Z (or the apparatus main body 2) having the elongated hole 62A is provided with a spring S that urges the rotation axis portion 31 of the cover 3Z frontward at all times. Even in such a structure, the rotation axis portion 31 can move rearward when the cover 3Z is opened, and the rotation axis portion 31 can move frontward when the cover 3Z is closed.

Although the connecting portion 5Y that connects the LED head 5X and the cover 3 together is provided in the respective embodiments, the present invention is not limited thereto. The connecting portion 5Y may be removed, and the LED head and the cover may be directly connected together.

Although the front surfaces 5C and the rear surfaces 5B of the exposure members 5 are implemented as plane surfaces extending in the vertical and horizontal directions in the respective embodiments, the present invention is not limited to the plane surfaces, and the front and rear surfaces of the exposure members may also be curved. Likewise, the surfaces of the process units 4 may also be curved. The exposure members may also have a plurality of front surfaces offset from each other with respect to a side-by-side direction of the process units 4. Moreover, the exposure members 5 may also have a plurality of rear surfaces offset from each other with respect to the side-by-side direction of the process units 4.

Although the reduced size of the image forming apparatus is realized by making the loci of the exposure members 5 close to a straight line and narrowing the intervals among the process units 4 in the respective embodiments, the present invention is not limited thereto. For instance, when the layout of the process cartridges and the shape of the exposure members are complicated, there is a conceivable case where the image forming apparatus can be miniaturized by making loci of the exposure members different from a straight line. In such a case, the axis may also be displaced so as to make the loci of the exposure members different from a straight line on purpose.

Although the direction of arrangement of the process units is oriented in the longitudinal direction in the respective embodiments, the present invention is not limited thereto, and the process units may also be arranged in the vertical and horizontal directions, and the like.

According to the embodiments of the invention, the axis of the support member can move in a direction orthogonal to an axial direction in association with rotation movement. Therefore, when compared with an image forming apparatus where an axis is fixed, it becomes possible to make; for instance, loci of rotation movements of exposure members, close to a straight line, thereby making the loci of rotation movements of the exposure members suitable for the layout of other members. Therefore, intervals among the process units can be narrowed, and the size of the image forming apparatus can be reduced.

What is claimed is:

1. An image forming apparatus comprising:

a plurality of process units arranged along a first direction and a second direction opposite to the first direction, each of the process units comprising a photoconductor;

a plurality of exposure members configured to expose the respective photoconductors and arranged such that the exposure members and the process units are alternately arranged along the first and second directions;

a rack including rack teeth; and a support member that supports the exposure members and includes a pinion gear and that is configured to rotate around an axis located in the first direction relative to the exposure members while the pinion gear is engaged with the rack teeth, such that the exposure members are advanced and retracted, in association with rotational movement of the support member, between an advanced position where the exposure members are respectively advanced into spaces defined between the adjacent process units and a retracted position where the exposure members are retracted from the respective spaces, wherein when the support member is rotated so that the exposure members move from the retracted position to the advanced position, the axis of the support member moves toward the process units, and wherein the support member is configured such that the axis moves along a direction orthogonal to an axial direction of the axis so that a locus of rotational movement of the exposure member is substantially a straight line in association with the rotational movement of the support member.

2. The image forming apparatus according to claim 1, wherein the axis moves in the first direction in association with the rotation movement of the support member toward the retracted position.

3. The image forming apparatus according to claim 2, wherein the axis is located at a retracted-position side relative to ends on the retracted-position side of the process units.

4. The image forming apparatus according to claim 2, wherein each of the process units has a surface extending substantially along a third direction and a fourth direction opposite to the third direction on a plane perpendicular to the axis, the surface having a first end located on a third direction side, wherein the space is defined between the surfaces of the adjacent process units, wherein the support member is configured to move, with respect to the third and fourth directions, in the third direction in association with the rotation movement of the support member from the advanced position toward the retracted position, wherein the axis is located in the third direction relative to the first ends of the surfaces of the process units.

5. The image forming apparatus according to claim 1, wherein the axis is configured to move in the second direction in association with the rotation movement of the support member toward the retracted position.

6. The image forming apparatus according to claim 5, wherein the axis is located at an advanced-position side relative to ends of the advanced-position side of the exposure members.

7. The image forming apparatus according to claim 5, wherein each of the process units has a surface extending substantially along a third direction and a fourth direction opposite to the third direction on a plane perpendicular to the axis, the space being defined between the surfaces of the adjacent process units, wherein the support member is configured to move, with respect to the third and fourth directions, in the third direction in association with the rotation movement of the support member from the advanced position toward the retracted position, wherein the axis is located in the fourth direction relative to the exposure members of the process units.

8. The image forming apparatus according to claim 1, wherein the axis is configured to move from an advanced-position side to a retracted-position side in association with the rotation movement of the support member toward the retracted position.

9. The image forming apparatus according to claim 1, wherein each of the process units has a surface extending substantially along a third direction and a fourth direction opposite to the third direction on a plane perpendicular to the axis, the space being defined between the surfaces of the adjacent process units, and wherein the axis is configured to move, with respect to the third and fourth directions, in the third direction in association with the rotation movement of the support member from the advanced position toward the retracted position.

10. The image forming apparatus according to claim 1, wherein the support member comprises a rotation unit that has the axis and allows the support member to rotate around the axis;

wherein the image forming apparatus further comprises:

pinion gears provided at the rotation unit; and racks that mesh with the pinion gears; and wherein the pinion gears are configured to roll over the racks to allow the rotation unit to move in association with rotation movement of the support member.

11. The image forming apparatus according to claim 1, wherein a plane of the rack teeth faces in a direction opposite to a direction in which the exposure members extend from the support member in the advanced position.

12. An image forming apparatus to which process units are removably attachable, the image forming apparatus comprising:

a process unit mounting portion that allows the process units to be mounted such that the process units are arranged along a first direction and a second direction opposite to the first direction, each of the process units comprising a photoconductor;

a plurality of exposure members configured to expose the respective photoconductors and arranged such that the exposure members and the process units are alternately arranged along the first and second directions when the process units are mounted to the process unit mounting portion;

a rack including rack teeth; and a support member that supports the exposure members and includes a pinion gear and that is configured to rotate around an axis located in the first direction relative to the exposure members while the pinion gear is engaged with the rack teeth, such that the exposure members are advanced and retracted, in association with rotational movement of the support member, between an advanced position where the exposure members are respectively advanced into spaces defined between the adjacent process units and a retracted position where the exposure members are retracted from the respective spaces, wherein when the support member is rotated so that the exposure members move from the retracted position to the advanced position, the axis of the support member moves toward the process units, and wherein the support member is configured such that the axis moves along a direction orthogonal to an axial direction of the axis so that a locus of rotational movement of the exposure member is substantially a straight line in association with the rotational movement of the support member.

13. The image forming apparatus according to claim 12, wherein a plane of the rack teeth faces in a direction opposite to a direction in which the exposure members extend from the support member in the advanced position.

14. An image forming apparatus comprising:

a photoconductor;

an exposure member configured to expose the photoconductor;

a rack including rack teeth; and a support member that supports the exposure member and includes a pinion gear and that is configured to rotate around an axis while the pinion gear is engaged with the rack teeth, wherein when the support member is rotated so that the exposure member moves toward the photoconductor, the axis of the support member moves toward the photoconductor, and wherein the support member is configured such that the axis moves along a direction orthogonal to an axial direction of the axis so that a locus of rotational movement of the exposure member is substantially a straight line in association with the rotational movement of the support member.

15. The image forming apparatus according to claim 14, wherein the exposure member comprises an array of light emitting portions.

16. The image forming apparatus according to claim 14, wherein the exposure member comprises an LED head comprising an array of light emitting diodes.

17. The image forming apparatus according to claim 14, wherein a plane of the rack teeth faces in a direction opposite to a direction in which the exposure member extends from the support member in a state that the exposure member is positioned close to the photoconductor.

18. An image forming apparatus comprising:

a main body including a front surface, a rear surface opposite to the front surface in a front-rear direction, a main top surface, and a main bottom surface opposite to the main top surface in a vertical direction perpendicular to the front-rear direction;

a plurality of process units arranged along the front-rear direction, each process unit having a photosensitive drum elongated in a right-left direction perpendicular to the vertical direction and the front-rear direction, the plurality of process units including a unit top surface, and a unit bottom surface opposite to the unit top surface in the vertical direction;

a plurality of the exposure members configured to expose photosensitive drums respectively, the plurality of the exposure members and the plurality of process units being alternately arranged along the front-rear direction;

a rack provided on the main body and including rack teeth, the rack teeth facing downward in the vertical direction; and a supporter configured to support the exposure members, the supporter disposed above the plurality of the process units and comprising a pinion gear configured to engage with the rack teeth, the pinion gear defining an axis extending along the right-left direction, the supporter configured to rotate around the axis of the pinion gear, the axis of the pinion gear disposed closer to the rear surface of the main body than the plurality of process units in the front-rear direction, the unit top surface of the plurality of process units disposed above the axis of pinion gear.

19. An image forming apparatus comprising:

a main body including a front surface, a rear surface opposite to the front surface in a front-rear direction, a main top surface, and a main bottom surface opposite to the main top surface in a vertical direction perpendicular to the front-rear direction;

a plurality of process units arranged along the front-rear direction, each process unit having a photosensitive drum elongated in a right-left direction perpendicular to the vertical direction and the front-rear direction, the plurality of process units including a unit top surface, and a unit bottom surface opposite to the unit top surface in the vertical direction;

a plurality of the exposure members configured to expose photosensitive drums respectively, the plurality of the exposure members and the plurality of process units being alternately arranged along the front-rear direction;

a rack provided on the main body and including rack teeth, the rack teeth facing upward in the vertical direction; and a supporter configured to support the exposure members, the supporter disposed above the plurality of the process units and comprising a pinion gear configured to engage with the rack teeth, the pinion gear defining an axis extending along the right-left direction, the supporter configured to rotate around the axis of the pinion gear, the axis of the pinion gear disposed closer to the rear surface of the main body than the plurality of process units in the front-rear direction, the axis of the pinion gear disposed above the unit top surface of the plurality of process units.

* * * * *